US005150903A

United States Patent [19]

Percic

[11] Patent Number: 5,150,903

[45] Date of Patent: Sep. 29, 1992

[54] GOLFER'S TRAINING DEVICE

[76] Inventor: Adelio Percic, 210 E. Sharon Dr., Phoenix, Ariz. 85022

[21] Appl. No.: 851,006

[22] Filed: Mar. 12, 1992

[51] Int. Cl.[5] ..... A63B 69/36; A43B 00/00

[52] U.S. Cl. ..... 273/188 A; 36/127

[58] Field of Search ..... 36/127, 124, 125, 132, 36/134, 136; 273/188 R, 188 A, 183 B, 32 C, 32.5, 58 C

[56] References Cited

U.S. PATENT DOCUMENTS

| | | | |
|---|---|---|---|
| 2,482,930 | 9/1949 | Norwood | 36/127 X |
| 3,165,315 | 1/1965 | Petrusek | 273/58 C |
| 3,614,107 | 10/1971 | Kinsey | 273/188 A |
| 3,731,405 | 5/1973 | Kincaid | 273/32.5 X |
| 4,147,356 | 4/1979 | Brandell | 283/188 A X |
| 4,407,079 | 10/1983 | Chiroff | 36/127 |
| 4,819,940 | 4/1989 | Davis | 273/187 B |
| 5,029,869 | 7/1991 | Veasey | 273/187 B |
| 5,062,643 | 11/1991 | Bibbey et al. | 273/188 A |
| 5,109,617 | 5/1992 | Nummy | 36/127 X |

*Primary Examiner*—George J. Marlo

*Attorney, Agent, or Firm*—Warren F. B. Lindsley

[57] ABSTRACT

A training device for fastening to the bottom of the heel of a golf shoe with the device comprising an apertured plate which is secured to the bottom of the heel by removing the cleats in the heel, placing the plate against the bottom of the heel and reinserting the cleats in the heel after penetrating the apertures in the plate. The plate is provided with a tab extending laterally therefrom over a portion of the periphery of the heel of the shoe. A spike is secured to the tab to extend laterally of the bottom of the heel for penetrating the ground to hold the leading foot of a golfer in place during a practice stance.

5 Claims, 1 Drawing Sheet

GOLFER'S TRAINING DEVICE

BACKGROUND OF THE INVENTION

This invention relates to a device for positioning the stance of a golfer to improve the consistency of his or her swing. More particularly, this invention relates to a device for holding the golfer's leading foot stable during a golf club swing, especially when the golfer is driving the ball. It should be noted that the leading foot is the left foot for a right-handed golfer. Stability at the front part of the leading foot for proper shifting of the weight of the golfer during a hitting motion is important. A stable leading foot allows the golfer to address the ball correctly and to drive the ball farther than if the golfer moves the front part of his leading foot during the swing.

The present invention keeps the golfer's leading foot in place by providing a device that is attached to the bottom of the heel of a golf shoe and stabilizes the golfer's foot through the use of a single peg or spike that extends downwardly from the heel of the golf shoe into the ground. This spike prevents lifting and twisting of the front part of the leading foot during a club swinging action.

DESCRIPTION OF THE PRIOR ART

The following patents appear to be of novelty interest but are not believed to be anticipatory of the invention claimed herein.

U. S. Pat. No. 3,624,107 discloses an attachment having a locator consisting of a post which can be pressed into the ground to keep the left heel flat during a golf swing.

U. S. Pat. No. 4,407,079 discloses a golf aid which may be attached to the bottom of a golf shoe by removing its cleats, then placing the device on the bottom of the shoe and then passing the cleats through slots and into holes in the sole of the shoe.

U. S. Pat. No. 5,029,869 discloses a device for keeping a golfer's foot stable comprising a base with a hole therein for allowing passage of the cleats of a normal golf shoe. Four spikes are mounted on the base with the device held on the foot by a suitable fastening means.

Other patents of interest comprise U. S. Pat. Nos. 4,819,940 and 5,062,643.

U. S. Pat. No. 4,819,940 discloses a wedge shaped bar for attaching to the bottom outer edge of the shoe causing the foot to tilt inwardly and forwardly simultaneously.

U. S. Pat. No. 5,062,643 discloses a golfing aid for limiting and restraining the pivot foot and comprises ground engaging spikes which are strapped to the bottom of the golfer's shoe.

None of these patents disclose and claim a golfer's aid for attaching to the heel of the pivot foot of the golfer.

SUMMARY OF THE INVENTION

In accordance with the invention claimed, a new and improved device is disclosed for clamping to the heel of the leading foot of a golfer when practicing on a driving range to improve the consistency of his or her swing.

It is, therefore, one object of this invention to provide a training device for maintaining the stance of a golfer on a driving range during both the back stroke and the power portion of the swing for optimum driving function.

Another object of this invention is to provide a simple and inexpensive golf training device which can be comfortably worn by a golfer on a driving range which will insure a smooth and accurate golf club swing without impeding the natural balance of the golfer.

A further object of this invention is to provide a training device for attachment to the heel of the leading foot of a golfer's shoe which regardless of individual idiosyncracies will uniformly correct a golfer's swing regardless of size, sex and degree of skill of the golfer.

Further objects and advantages of this invention will become apparent as the following description proceeds, and the features of novelty which characterize the invention will be pointed out with particularity in the claims annexed to and forming a part of this specification.

BRIEF DESCRIPTION OF THE DRAWING

The present invention may be more readily described with reference to the accompanying drawing, in which.

DESCRIPTION OF THE PREFERRED EMBODIMENT

Figure 1:
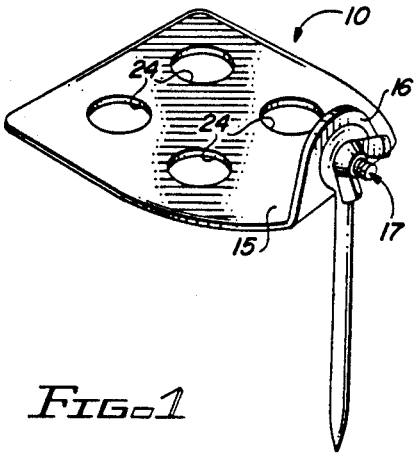
FIG. 1 is a perspective view of a training aid for clamping to the heel of a golfer's shoe.

Referring more particularly to the drawing by characters of reference, FIGS. 1–5 disclose a training aid or device 10 for fastening to bottom 11 of a heel 12 of a golfer's shoe 13. Cleats 14 are threadedly removed from the heel of the shoe and device 10 is then positioned thereagainst after which the cleats are replaced in threaded engagement with the heel of the shoe for holding device 10 firmly against the bottom 11 of heel 12 of the shoe.

Figure 2:
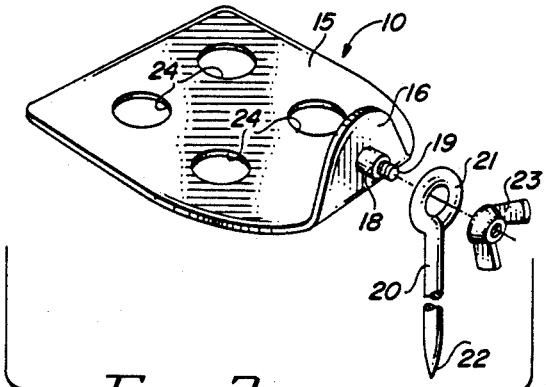
FIG. 2 is an exploded view of FIG. 1.
Figure 4:
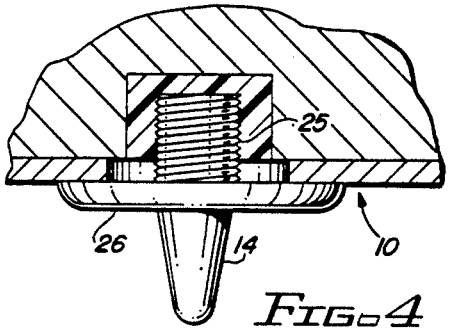
FIG. 4 is an enlargement of the circled area marked 4 of FIG. 3.

As noted from FIGS. 1 and 2, training device 10 comprises a flat metallic or plastic apertured plate 15 that is bent over at one end to form a flange or tab 16 extending laterally and/or substantially perpendicular therefrom. This tab is provided with an aperture extending therethrough for receiving a flat headed bolt 17. Bolt 17 has a collar 18 fitted axially over a threaded portion 19 of the bolt for receiving in sliding fit thereover a spike 20. Spike 20 has a circular apertured end 21 for fitting over collar 18 at one end and a pointed end 22 at its ground engaging portion. Spike 20 is held in place on bolt 17 by a wing nut 23 which threadedly engages the threaded portion 19 of the bolt.

To secure device 10 to the bottom of the heel of a golfer's shoe prior to use on a driving range, one merely threadedly removes cleats 14 from the heel of a golfer's shoe and then places device 10 against bottom 11 of the heel. At this point, the threaded ends of cleats 14 removed from heel 12 of shoe 13 are reinserted through apertures 24 in plate 15 and threaded into internally threaded apertures 25 in heel 12 of shoe 13 with collar 26 of cleat 14 covering apertures 24 in plate 15. It should be noted that the size of apertures 24 are greater than the size of apertures 25 in heel 12 with apertures 24 providing an adjustment for small misalignments of apertures 25 relative to apertures 24 in plate 15.

Figure 3:
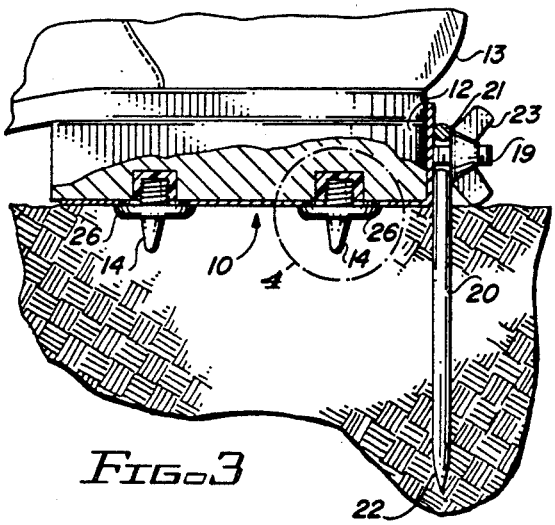
FIG. 3 is a view partially in cross section of the training aid shown in FIG. 1 clamped to the bottom of the heel of a golfer's shoe.
Figure 5:
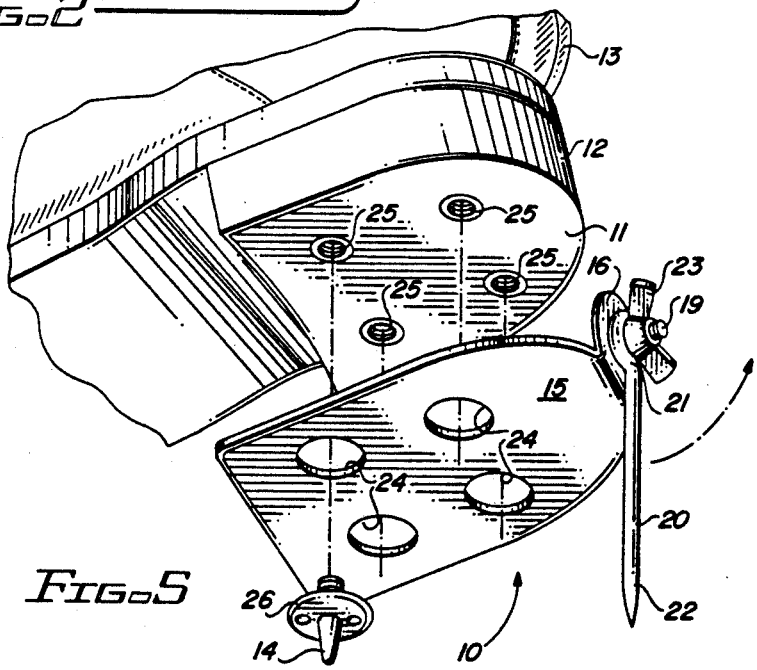
FIG. 5 is an exploded perspective view of a golfer's shoe with cleats removed ready for fastening the claimed device to the bottom of the heel of a golfer's shoe.

After the plate is secured to the heel of the left golf shoe of a right-handed golfer and the golfer has stepped onto the grass of the driving range, spike 20 is arranged in a vertical position as shown in FIGS. 1, 3 and 5, and the wing nut 23 is tightened. With spike 20 in place, the golfer takes his or her stance with the pivot foot heel resting against the surface of the ground and the pin or spike disposed in the ground. This added pin or spike keeps the front part of the leading foot of the golfer from shifting laterally during his or her swing while allowing the heel of the leading foot to rise. Device 10 keeps the leading foot stable while allowing proper weight shift and greater force to be applied to the golf club when driving the ball.

The presence of device 10 on the golfer's foot serves as a mental reminder to the golfer to keep his or her foot still. Eventually the golfer will learn the proper stance at which time the golfer should be able to strike the ball properly without using the device. Thus, device 10 is a training aid to be used by the golfer to achieve the correct stance.

It should be noted that the wing nut 23 may be loosened so that spike 20 may be rotated to a position where the spike is substantially parallel with the surface of the ground and then tightened thereby not interfering with the golfer's movement on or off the golf course as evident from the dash lines in FIG. 5. Further, spike 20 may be removed from device 10 with plate 15 remaining in place for normal walking or playing on the golf course.

Although but one embodiment of the invention has been illustrated and described, it will be apparent to those skilled in the art that various changes and modifications may be made therein without departing from the spirit of the invention or from the scope of the appended claims.

What is claimed is:

1. A training device for holding a golfer's leading foot stable during a golf club swinging function comprising:

an apertured base plate, said plate being secured to the bottom surface of the heel of a golf shoe by removing threaded cleats from internally threaded apertures in the bottom surface of the heel of the shoe, placing one surface of said plate against the bottom surface of the heel and inserting the removed cleats through the apertures in said plate for threadedly engaging with corresponding apertures in the heel of the shoe, said plate having a tab extending laterally thereof for extending over a portion of the periphery of the back of the heel of the shoe, said tab having an aperture extending therethrough, a threaded bolt attached to and extending outwardly from said tab substantially parallel to said plate, and having a collar extending around a part thereof adjacent said tab, an elongated spike one end of which pivotally surrounds said collar and the other end of which is provided with a point for penetrating the ground, and means for threadedly engaging said bolt for holding said spike in a position extending laterally outwardly of said plate.

2. The training device set forth in claim 1 wherein: said means comprises a wing nut.

3. The training device set forth in claim 1 wherein: said base plate comprises a plurality of apertures.

4. The training device set forth in claim 1 wherein: said base plate comprises a metallic material.

5. The training device set forth in claim 1 wherein: said base plate comprises a plastic material.

* * * * *